US010192510B2

(12) United States Patent
Huang

(10) Patent No.: US 10,192,510 B2
(45) Date of Patent: Jan. 29, 2019

(54) SOURCE DRIVING MODULE GENERATING TWO GROUPS OF GAMMA VOLTAGES AND LIQUID CRYSTAL DISPLAY DEVICE USING SAME

(71) Applicant: Shenzhen China Star Optoelectronics Technology Co., Ltd., Shenzhen, Guangdong (CN)

(72) Inventor: Xiaoyu Huang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 206 days.

(21) Appl. No.: 15/125,159

(22) PCT Filed: Aug. 3, 2016

(86) PCT No.: PCT/CN2016/093005

§ 371 (c)(1),
(2) Date: Sep. 10, 2016

(87) PCT Pub. No.: WO2018/014372

PCT Pub. Date: Jan. 25, 2018

(65) Prior Publication Data

US 2018/0218705 A1 Aug. 2, 2018

(30) Foreign Application Priority Data

Jul. 19, 2016 (CN) ..... 2016 1 0570748

(51) Int. Cl.
*G09G 3/36* (2006.01)

(52) U.S. Cl.
CPC ..... *G09G 3/3696* (2013.01); *G09G 3/36* (2013.01); *G09G 3/3685* (2013.01); *G09G 2320/0673* (2013.01)

(58) Field of Classification Search
CPC ..... G09G 3/3696; G09G 3/3685; G09G 2320/0673
See application file for complete search history.

(56) References Cited

U.S. PATENT DOCUMENTS

2010/0149151 A1* 6/2010 Nam ..... G09G 3/3614 345/211
2013/0135186 A1* 5/2013 Zhang ..... G09G 3/3696 345/88

(Continued)

FOREIGN PATENT DOCUMENTS

CN 1821842 A 8/2006
CN 1936682 A 3/2007

(Continued)

*Primary Examiner* — Ryan A Lubit
(74) *Attorney, Agent, or Firm* — Andrew C. Cheng

(57) ABSTRACT

A source driving module is disclosed, for providing a data signal to a display panel. The source driving module includes a gamma voltage generator, and a data driver receiving a gamma voltage outputted from the gamma voltage generator and generating a corresponding data signal to a display panel according to the gamma voltage. Wherein, the gamma voltage generator includes a first gamma generator and a second gamma voltage generator, the first gamma generator outputs a first gamma voltage, and the second gamma generator outputs a second gamma voltage. Wherein, the source driving module further comprises a voltage selector adapted for selecting one of the first gamma voltage and the second gamma voltage in a same moment to input to the data driver. A liquid crystal display device including the source driving module is also disclosed.

14 Claims, 4 Drawing Sheets

(56) References Cited

U.S. PATENT DOCUMENTS

| | | | | |
|---|---|---|---|---|
| 2014/0022225 | A1* | 1/2014 | Lee | G09G 3/20 345/211 |
| 2014/0125714 | A1* | 5/2014 | Pyo | G09G 3/3233 345/691 |
| 2015/0145758 | A1* | 5/2015 | Lee | G09G 3/3648 345/87 |
| 2015/0145898 | A1 | 5/2015 | Hwang | |
| 2017/0061928 | A1* | 3/2017 | Kim | G09G 3/20 |

FOREIGN PATENT DOCUMENTS

| | | | |
|---|---|---|---|
| CN | 102411914 | A | 4/2012 |
| CN | 103035212 | A | 4/2013 |
| CN | 104658496 | A | 5/2015 |

* cited by examiner

SOURCE DRIVING MODULE GENERATING TWO GROUPS OF GAMMA VOLTAGES AND LIQUID CRYSTAL DISPLAY DEVICE USING SAME

BACKGROUND OF THE INVENTION

1. Field of the Invention

The present invention relates to a display technology field, and more particularly to a source driving module and a liquid crystal display device including the source driving module.

2. Description of Related Art

A Liquid Crystal Display (LCD) is a flat and ultrathin display device, and the LCD is formed by a certain number of color or black-white pixels, and being placed in front of a light source or a reflective surface. The power consumption of the liquid crystal display device is low, and having features of high picture quality, small size, light weight such that the LCD is favored by everyone and becomes a mainstream of the display device. Currently, a liquid crystal display device is mainly based on a Thin Film Transistor (TFT) liquid crystal display device, and a liquid crystal panel is a main part of the liquid crystal display device. The liquid crystal generally includes a color filter substrate and a TFT array substrate which are disposed oppositely and a liquid crystal layer clamped between the two substrates.

The driving of a liquid crystal display device is to provide scanning signals and data signals to each sub-pixel of a display panel respectively by a gate driving module and a source driving module. Voltage differences among different data signal voltages and a common electrode voltage cause different liquid crystal rotation angles in order to form brightness differences. That is, a display of the liquid crystal panel forms different grayscale levels.

Wherein, the source driving module includes a gamma voltage generator and a data driver. The gamma voltage generator outputs a gamma voltage, and the data driver receives the gamma voltage and generates a corresponding data signal to the display panel according to the gamma voltage. Wherein, an arrangement of sub-pixel units in the display panel has two common ways: a horizontal arrangement and a vertical arrangement. Using a display panel only having three sub-pixels of a red sub-pixel R, a green sub-pixel and a blue sub-pixel as an example. As shown in FIG. 1, "sub-pixels arranged horizontally" corresponds to a driving method of "one scanning line (Gate) and three data lines (Data)", referred to as a "1G3D" mode; As shown in FIG. 2, "sub-pixels arranged vertically" corresponds to a driving method of "three scanning lines (Gate) and one data line (Data)", referred to as a "3G1D" mode.

For the way of sub-pixels arranged vertically, a red sub-pixel R, a green sub-pixel G and a blue sub-pixel B in each column are connected with a same data line. A gate driving module scans row by row sequentially, and a data driver provides data signal to different sub-pixels according to a same gamma voltage (a same gamma curve) generated by a gamma voltage generator. The above driving way of data signal charges sub-pixels having different colors according to a same gamma curve, a color shift problem because of insufficient charging of sub-pixels is existed so as to decrease the display quality of the display panel.

SUMMARY OF THE INVENTION

In view of the shortage of the conventional art, the present invention provides a source driving module which can generates two groups of gamma voltages, and driving the sub-pixels in a same column of the display panel according to the two groups of gamma voltages so as to effectively improve the color shift problem because of insufficient charging of sub-pixels. Specifically, the present invention focus on the display panel having the sub-pixels arranged vertically, which can improve the display quality of the display panel.

In order to achieve the above purpose, the present invention adopts the following technology solutions:

A source driving module for providing a data signal to a display panel, comprising: a gamma voltage generator; a data driver receiving a gamma voltage outputted from the gamma voltage generator and generating a corresponding data signal to a display panel according to the gamma voltage; wherein, the gamma voltage generator includes a first gamma generator and a second gamma voltage generator, the first gamma generator outputs a first gamma voltage, and the second gamma generator outputs a second gamma voltage; and wherein, the source driving module further comprises a voltage selector adapted for selecting one of the first gamma voltage and the second gamma voltage in a same moment to input to the data driver.

Wherein, the voltage selector comprises a first switch and a second switch; the first gamma voltage generator is connected to the data driver through the first switch, the second gamma generator is connected to the data driver through the second switch; in a same moment, when one of the first switch and the second switch is controlled to be turned on, the first gamma voltage or the second gamma voltage corresponding to the first switch or the second switch which is turned on is inputted to the data driver.

Wherein, the first switch and the second switch are connected to a same control signal, the control signal comprises a first status and a second status; when the control signal is under the first status, the first switch is turned on, and the second switch is turned off; when the control signal is under the second status, the first switch is turned off, and the second switch is turned on.

Wherein, the first switch and the second switch are connected to a same control signal, the control signal is a square-wave signal; when the square-wave signal is under a high-voltage level, the first switch is turned on, and the second switch is turned off; when the square-wave signal is under a low-voltage level, the first switch is turned off, and the second switch is turned on.

Wherein, a period of the square-wave signal is T1, a period of a row synchronization signal of the display panel is T2, T1=3×T2; a duty ratio of the square-wave signal is 2/3.

Wherein, a period of the square-wave signal is T1, a period of a row synchronization signal of the display panel is T2, T1=2×T2; a duty ratio of the square-wave signal is 1/2.

Wherein, the first switch is a N-channel MOS transistor, a gate of the N-channel MOS transistor is connected to the control signal, a source of the N-channel MOS transistor is connected to the first gamma voltage generator, and a drain of the N-channel MOS transistor is connected to the data driver; the second switch is a P-channel MOS transistor, a gate of the P-channel MOS transistor is connected to the control signal, a source of the P-channel MOS transistor is connected to the second gamma voltage generator, and a drain of the P-channel MOS transistor is connected to the data driver.

Wherein, the data diver comprises a data driving chip connected to the display panel through a chip on film structure.

Another aspect of the present invention provides a liquid crystal display device, comprising: a display panel, providing with multiple data lines and multiple scanning lines which are disposed vertically and horizontally, wherein, sub-pixels are formed at intersection regions of the data lines and the scanning lines, the sub-pixels in a same row are connected with a same scanning line, the sub-pixels in a same column is connected with a same data line, three sub-pixels corresponding to each pixel unit are arranged vertically; a source driving module adapted for providing data signals to the sub-pixels in the display panel through the data lines; a gate driving module adapted for providing scanning signals to the sub-pixels in the display panel through the scanning lines; a timing controller adapted for providing a timing control signal to the source driving module and the gate driving module, and sending an image signal waited to be displayed to the source driving module.

Wherein, the three sub-pixels corresponding to each pixel unit are sequentially a red sub-pixel, a green sub-pixel and a blue sub-pixel.

In summary, in the source driving module and the liquid crystal display device provided by the embodiment of the present invention, the source driving module is provided with two gamma voltage generators that generate two groups of gamma voltages, one of the two groups of the gamma voltages is inputted to the data driver through the selection of the voltage selector. Through the switching and the selection of the voltage selector, the sub-pixels in a same column in a display panel can be driven according to the two groups of gamma voltages in order to effectively improve the color shift problem because of insufficient charging of the sub-pixels. Furthermore, the two groups of the gamma voltages can commonly use data driving device in one data driver to save the cost. Besides, the source driving module provided by the present invention is simple, easily to be realized, and beneficial to large-scale industrial application.

DETAILED DESCRIPTION OF THE PREFERRED EMBODIMENT

Figure 1:
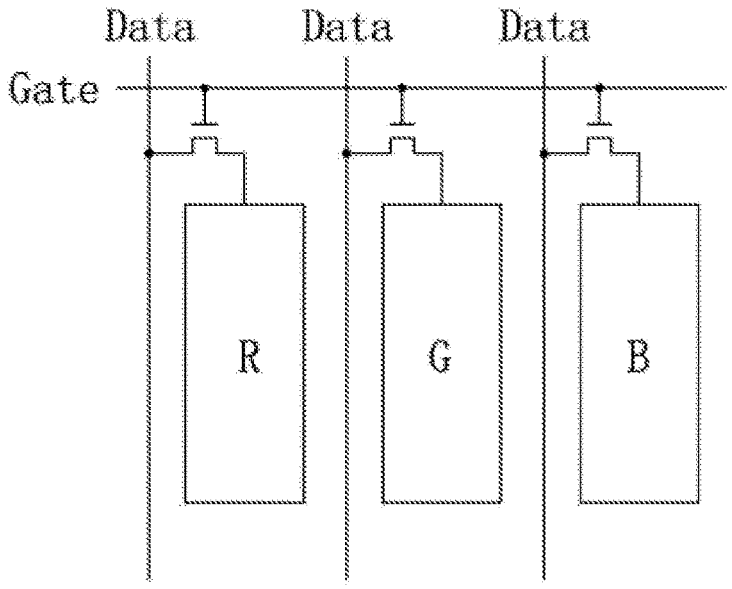
FIG. 1 (Prior Art)
FIG. 1 is a schematic diagram of horizontally arranging sub-pixels in a display panel according to the conventional art.
Figure 2:
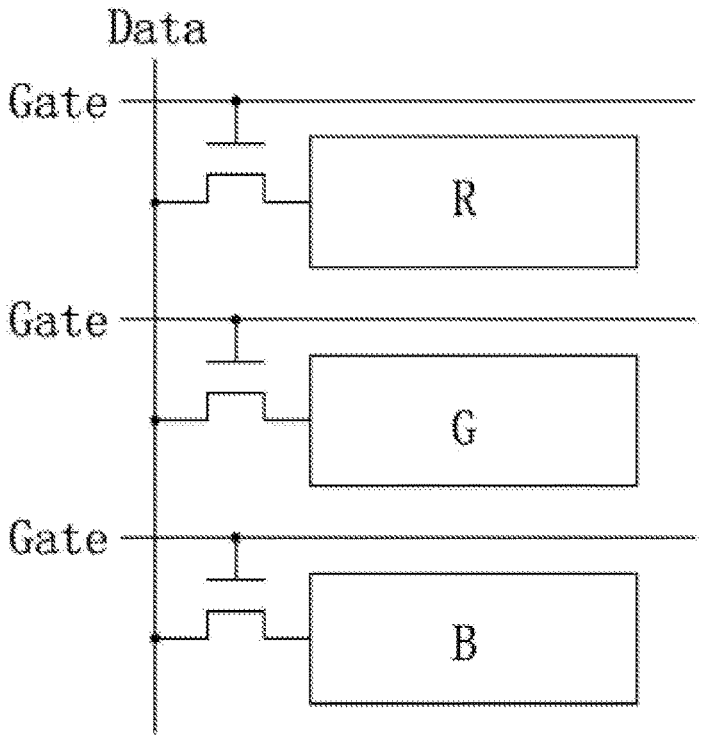
FIG. 2 (Prior Art)
FIG. 2 is a schematic diagram of vertically arranging sub-pixels in a display panel according to the conventional art.

In order to let the purpose, the technology solution and features of the present invention to be clearer, the following content combines the drawings for illustrating the specific embodiment of the present invention in detail. The example of the preferred embodiment is illustrated in the drawings. The embodiments of the present invention described in the drawings are only exemplary, and the present invention is not limited to the embodiments.

Here, it should be noted that in order to avoid obscuring the present disclosure because of unnecessary detail, the figures only show structure and/or processing steps that are closely related according to the present solution, and the other details that are not related to the present disclosure is omitted.

Figure 3:
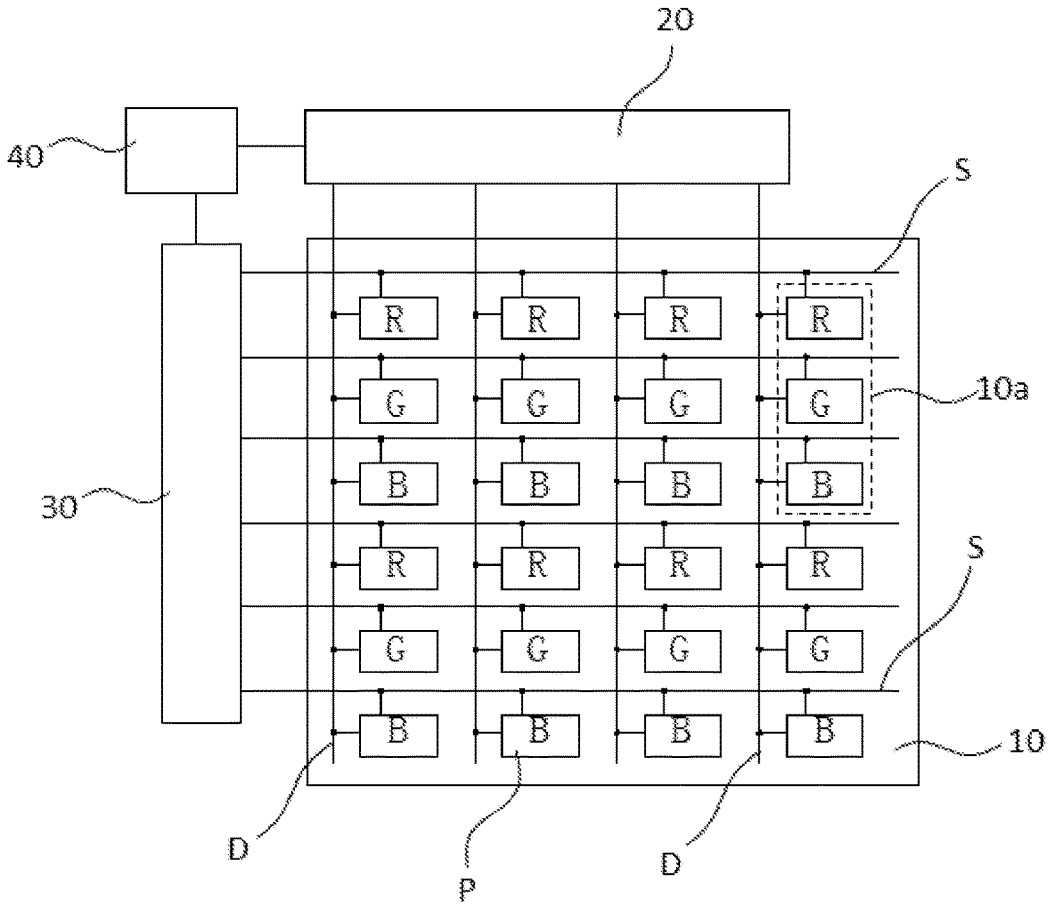
FIG. 3 is a schematic diagram of a liquid crystal display device according to an embodiment of the present invention.

The present embodiment provides a liquid crystal display device, as shown in FIG. 3, the liquid crystal display device includes a display panel 10, a source driving module 20, a gate driving module 30 and a timing controller 40. Wherein, the timing controller 40 is used for providing a timing control signal to the source driving module 20 and the gate driving module 30, and sending an image signal waited to be displayed to the source driving module 20. The source driving module 20 generates a corresponding data signal to the display panel 10 according to the timing control signal and the image signal waited to be displayed which are received from the timing controller 40. The gate driving module 30 generates a corresponding scanning signal to the display panel 10 according to the timing control signal received from the timing controller 40.

Wherein, the display panel 10 is provided with multiple data lines D and multiple scanning lines S which are disposed vertically and horizontally. Sub-pixels P are formed at intersection regions of the data lines D and the scanning lines S. The sub-pixels in a same row are connected with a same scanning line S, the sub-pixels in a same column is connected with a same data line D. It should be noted that the FIG. 3 only exemplarily shows a portion of the data lines D, the scanning lines S and the sub-pixels P of the display panel 10.

In the present embodiment, as shown in FIG. 3, three sub-pixels P corresponding to each pixel unit 10*a* in the display panel 10 are arranged vertically. The three sub-pixels P corresponding to each pixel unit 10*a* are sequentially a red sub-pixel R, a green sub-pixel G and a blue sub-pixel B.

Figure 4:
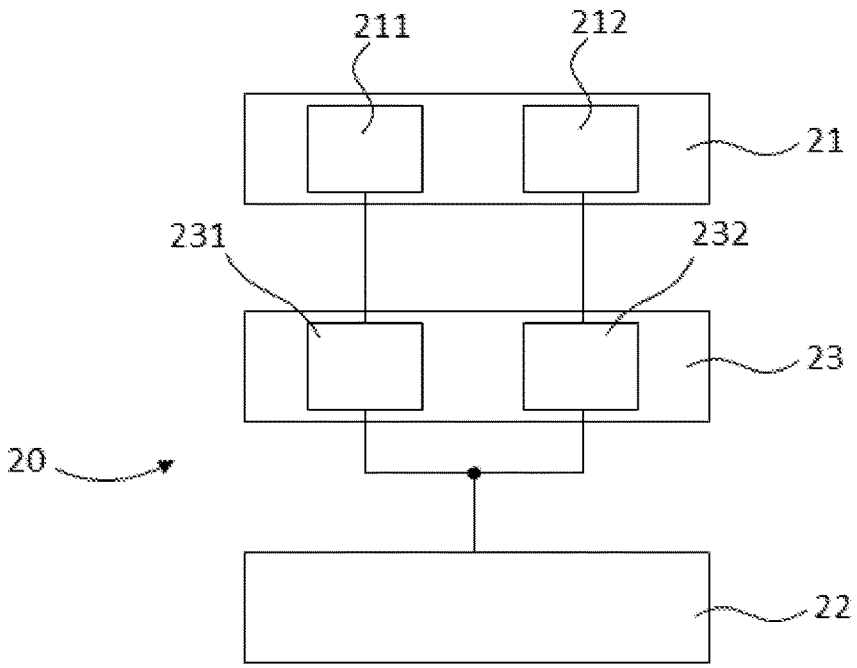
FIG. 4 is a schematic diagram of a source driving module according to an embodiment of the present invention.

In the present embodiment, for the three sub-pixels P corresponding to each pixel unit 10*a* arranged vertically, a new source driving module 20 is provided. As shown in FIG. 4, the source driving module 20 includes a gamma voltage generator 21 and a data driver 22. The data driver 22 receives the gamma voltage outputted from the gamma voltage generator 21, and generating a corresponding data signal to provide to the display panel according to the gamma voltage.

Wherein, the gamma voltage generator 21 includes a first gamma generator 211 and a second gamma voltage generator 212. The first gamma generator 211 generates and outputs a first gamma voltage, and the second gamma voltage generator 212 generates and outputs a second gamma voltage. The source driving module 20 further includes a voltage selector 23. The voltage selector 23 is connected between the gamma voltage generator 21 and the data driver 22 for selecting one of the first gamma voltage and the second gamma voltage in a same moment to input to the data driver 22. Accordingly, the sub-pixels P of each column being provided with data signals by the data driver 22, through the switching and selection of the voltage selector 23, the data driver 22 can drive the sub-pixels P in a same column according to two groups of gamma voltages, which can effective improve the color shift problem caused by insufficient charging of the sub-pixels P in order to increase the display quality of the display panel.

Furthermore, as shown in FIG. 4, the voltage selector includes a first switch 231 and a second switch 232. The first gamma voltage generator 211 is connected to the data driver 22 through the first switch 231, and the second gamma generator 212 is connected to the data driver 22 through the second switch 232. In the same moment, when one of the first switch 231 and the second switch 232 is controlled to be turned on, the first gamma voltage or the second gamma voltage corresponding to the first switch 231 or the second switch 232 which is turned on is inputted to the data driver 22. Wherein, the first switch 231 and the second switch 232 can be connected to a same control signal, and using the same control signal to control the first switch 231 and the second switch 232 to be turned on and turned off. Specifically, the control signal includes a first status and a second status. When the control signal is under the first status, the first switch 231 is turned on, and the second switch 232 is turned off. When the control signal is under the second status, the first switch 231 is turned off, and the second switch 232 is turned on.

Figure 5:
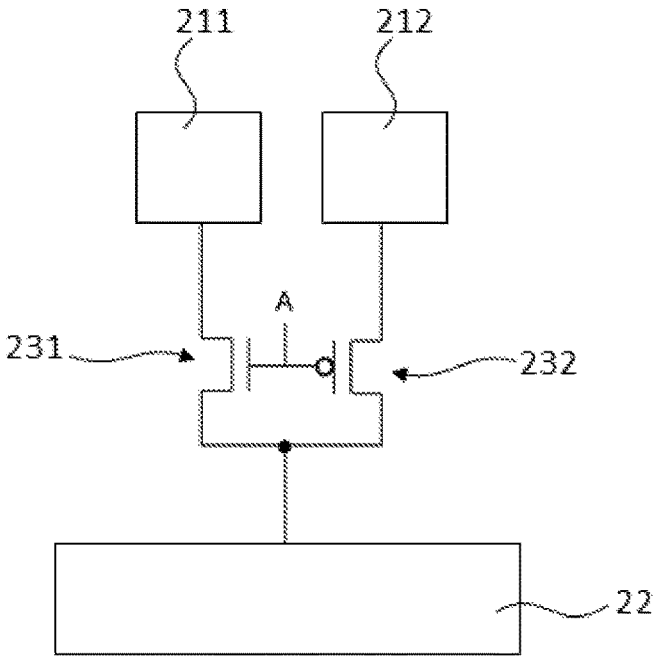
FIG. 5 is a circuit diagram of a voltage selector according to an embodiment of the present invention.

More specifically, in the present embodiment, as shown in FIG. 5, the first switch 231 is a N-channel MOS transistor, a gate of the N channel MOS transistor is connected to a control signal A, a source of the N channel MOS transistor is connected to the first gamma voltage generator 211, and a drain of the N channel MOS transistor is connected to the data driver 22. The second switch 232 is a P-channel MOS transistor, a gate of the P-channel MOS transistor is connected to the control signal A, a source of the P-channel MOS transistor is connected to the second gamma voltage generator 212, and a drain of the P-channel MOS transistor is connected to the data driver 22. The control signal A is a square-wave signal. When the square-wave signal is at a high voltage level status, the first switch 231 is turned on, and the second switch 232 is turned off. The first gamma voltage generated by the first gamma voltage generator 211 is inputted to the data driver 22. When the square-wave signal is at a low voltage level status, the first switch 231 is turned off, and the second switch 232 is turned on. At this time, the second gamma voltage generated by the second gamma voltage generator 212 is inputted to the data driver 22.

Figure 6:
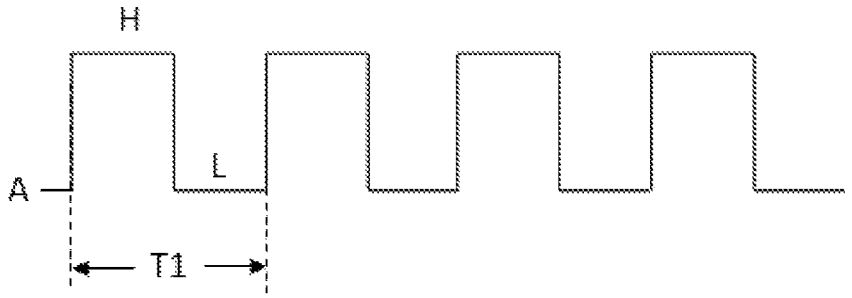
FIG. 6 is a waveform diagram of a control signal of the voltage selector according to an embodiment of the present invention.

In the present embodiment, as shown in FIG. 6, a period of the square-wave signal (the control signal A) is T1, and a duty ratio of the square-wave signal is 1/2. The relationship between the period T1 of the square-wave signal and a period T2 of a row synchronization signal (HSYNC) of the display panel is: T1=2×T2. Here, the time of the period T2 of the row synchronization signal (HSYNC) is a scanning time of the sub-pixels of each row, that is, a charging time. Accordingly, combining with FIG. 3 to FIG. 6, starting from the high voltage level of the square-wave signal, the gate driving module 30 scans row by row, and the charging process of the source driving module 20 for the sub-pixels P of each column is as followings:

(1) At starting, the red sub-pixels at a first row are connected with the scanning signal, the square-wave signal is at a status of high-voltage level H, the first switch 231 is turned on, the second switch 232 is turned off, the data driver 22 receives the first gamma voltage generated by the first gamma voltage generator 211, generating a corresponding data signal, and inputting the corresponding data signal to charge the red sub-pixels R at the first row;

(2) when the green sub-pixels G at a second row is connected with the scanning signal, the square-wave signal is at a status of low-voltage level L, the first switch 231 is turned off, the second switch 232 is turned on, the data driver 22 receives the second gamma voltage generated by the second gamma voltage generator 212, generating a corresponding data signal and inputting the corresponding data signal to charge the green sub-pixels G at the second row;

(3) when the blue sub-pixels B at a third row is connected with the scanning signal, the square-wave signal is changed to the status of high-voltage level H, the first switch 231 is turned on, the second switch 232 is turned off, the data driver 22 receives the first gamma voltage generated by the first gamma voltage generator 211, generating a corresponding data signal, inputting the corresponding data signal to charge the blue sub-pixels B at the third row;

(4) when the red sub-pixels R at a fourth row is connected with the scanning signal, the square-wave signal is changed to the status of low-voltage level L, the first switch 231 is turned off, the second switch 232 is turned on, the data driver 22 receives the second gamma voltage generated by the second gamma voltage generator 212, generating a corresponding data signal, inputting the corresponding data signal to charge the red sub-pixels R at the fourth row.

And so forth, for the sub-pixels P having different colors at each column and adjacent rows, the data driver 22 sequentially and alternately charges the sub-pixels P according to the data signals generated by the first gamma voltage and the second gamma voltage. For the red sub-pixel R, the green sub-pixel G and the blue sub-pixel B corresponding to each pixel unit 10*a*, one or two sub-pixels are charged according to the first gamma voltage, and the other two or one sub-pixel is charged according to the second gamma voltage.

Figure 7:
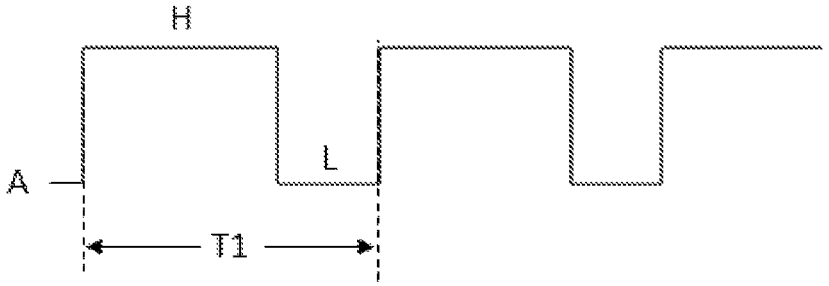
FIG. 7 is a waveform diagram of a control signal of the voltage selector according to another embodiment of the present invention.

In another preferred embodiment, as shown in FIG. 7, a period of the square-wave signal (the control signal A) is T1, a duty ratio of the square-wave signal is 2/3. The relationship between the period T1 of the square-wave signal and a period T2 of a row synchronization signal (HSYNC) of the display panel is: T1=3×T2. Accordingly, combining with FIG. 3 to FIG. 6, starting from the high voltage level of the square-wave signal, the gate driving module 30 scans row by row, and the charging process of the source driving module 20 for the sub-pixels P of each column is as following:

(1) At starting, the red sub-pixels R at a first row are connected with the scanning signal, the square-wave signal is at a status of high-voltage level H, the first switch 231 is turned on, the second switch 232 is turned off, the data driver 22 receives the first gamma voltage generated by the first gamma voltage generator 211, generating a corresponding data signal, and inputting the corresponding data signal to charge the red sub-pixels R at the first row;

(2) when the green sub-pixels G at a second row is connected with the scanning signal, the square-wave signal is still at the status of high-voltage level H, the first switch 231 is turned on, the second switch 232 is turned off, the data driver 22 receives the first gamma voltage generated by the first gamma voltage generator 211, generating a corresponding data signal and inputting the corresponding data signal to charge the green sub-pixels G at the second row;

(3) when the blue sub-pixels B at a third row is connected with the scanning signal, the square-wave signal is changed to the status of low-voltage level L, the first switch 231 is turned off, the second switch 232 is turned on, the data driver 22 receives the second gamma voltage generated by the second gamma voltage generator 212, generating a corresponding data signal, inputting the corresponding data signal to charge the blue sub-pixels B at the third row;

(4) when the red sub-pixels R at a fourth row is connected with the scanning signal, the square-wave signal is changed to the status of high-voltage level H, the first switch 231 is turned off, the second switch 232 is turned on, the data driver 22 receives the first gamma voltage generated by the first gamma voltage generator 211, generating a corresponding data signal, inputting the corresponding data signal to charge the red sub-pixels R at the fourth row.

And so forth, for the red sub-pixel R and the green sub-pixel G corresponding to each pixel unit 10*a*, the data driver 22 performs charging according to the data signal generated by the first gamma voltage. For the blue sub-pixel B in each pixel unit 10*a*, the data driver 22 performs charging according to the data signal generated by the second gamma voltage. Of course, a starting position of the high-voltage level of the square-wave signal can be adjusted such that setting the green sub-pixel G and the blue sub-pixel B in each pixel unit 10*a* are charged according to the first gamma voltage, and the red sub-pixel R in each pixel unit 10*a* is charged according to the second gamma voltage. Or, the blue sub-pixel B and the red sub-pixel R in each pixel unit 10*a* are charged according to the first gamma voltage, and the green sub-pixel G in each pixel unit 10*a* is charged according to the second gamma voltage.

Furthermore, in the present embodiment, the data driver 22 includes a data driving chip connected to the display panel 10 through a chip on film structure, that is, a COF (Chip On Film) chip. The number of the COF chip can be multiple. Each COF chip corresponds to multiple columns of the sub-pixels located at different regions. Each COF chip is connected to the first gamma voltage generator 211 and the second gamma voltage generator 212 through the voltage selector 23.

In summary, in the source driving module and the liquid crystal display device provided by the embodiment of the present invention, the source driving module is provided with two gamma voltage generators that generate two groups of gamma voltages, one of the two groups of the gamma voltages is inputted to the data driver through the selection of the voltage selector. Through the switching and the selection of the voltage selector, the sub-pixels in a same column in a display panel can be driven according to the two groups of gamma voltages in order to effectively improve the color shift problem because of insufficient charging of the sub-pixels. Furthermore, the two groups of the gamma voltages can commonly use data driving device in one data driver to save the cost. Besides, the source driving module provided by the present invention is simple, easily to be realized, and beneficial to large-scale industrial application.

It should be noted that, herein, relational terms such as first and second, and the like are only used to distinguish one entity or operation from another entity or operation. It is not required or implied that these entities or operations exist any such relationship or order between them. Moreover, the terms "comprise," include," or any other variation thereof, are intended to cover a non-exclusive inclusion, such that a series of elements including the process, method, article or device that includes not only those elements but also other elements not expressly listed or further comprising such process, method, article or device inherent elements. Without more constraints, by the statement "comprises one . . . " element defined does not exclude the existence of additional identical elements in the process, method, article, or apparatus.

The above embodiment does not constitute a limitation of the scope of protection of the present technology solution. Any modifications, equivalent replacements and improvements based on the spirit and principles of the above embodiments should also be included in the protection scope of the present technology solution.

What is claimed is:

1. A source driving module for providing a data signal to a display panel, comprising:

a gamma voltage generator;

a data driver receiving a gamma voltage outputted from the gamma voltage generator and generating a corresponding data signal to a display panel according to the gamma voltage;

wherein the gamma voltage generator includes a first gamma generator and a second gamma voltage generator, the first gamma generator outputs a first gamma voltage, and the second gamma generator outputs a second gamma voltage;

wherein the source driving module further comprises a voltage selector adapted for selecting one of the first gamma voltage and the second gamma voltage in a same moment to input to the data driver;

wherein the voltage selector comprises a first switch and a second switch; the first gamma voltage generator is connected to the data driver through the first switch, the second gamma generator is connected to the data driver through the second switch; in a same moment, when one of the first switch and the second switch is controlled to be turned on, the first gamma voltage or the second gamma voltage corresponding to the first switch or the second switch which is turned on is inputted to the data driver;

wherein the first switch and the second switch are connected to a same control signal, the control signal is a square-wave signal; when the square-wave signal is under a high-voltage level, the first switch is turned on, and the second switch is turned off; when the square-wave signal is under a low-voltage level, the first switch is turned off, and the second switch is turned on; and wherein a period of the square-wave signal is T1, a period of a row synchronization signal of the display panel is T2, T1=3×T2; a duty ratio of the square-wave signal is 2/3.

2. The source driving module according to claim 1, wherein the first switch is a N-channel MOS transistor, a gate of the N-channel MOS transistor is connected to the control signal, a source of the N-channel MOS transistor is connected to the first gamma voltage generator, and a drain of the N-channel MOS transistor is connected to the data driver; the second switch is a P-channel MOS transistor, a gate of the P-channel MOS transistor is connected to the control signal, a source of the P-channel MOS transistor is connected to the second gamma voltage generator, and a drain of the P-channel MOS transistor is connected to the data driver.

3. The source driving module according to claim 1, wherein the data diver comprises a data driving chip connected to the display panel through a chip on film structure.

4. A source driving module for providing a data signal to a display panel, comprising:

a gamma voltage generator;

a data driver receiving a gamma voltage outputted from the gamma voltage generator and generating a corresponding data signal to a display panel according to the gamma voltage;

wherein the gamma voltage generator includes a first gamma generator and a second gamma voltage generator, the first gamma generator outputs a first gamma voltage, and the second gamma generator outputs a second gamma voltage;

wherein the source driving module further comprises a voltage selector adapted for selecting one of the first gamma voltage and the second gamma voltage in a same moment to input to the data driver;

wherein the voltage selector comprises a first switch and a second switch; the first gamma voltage generator is connected to the data driver through the first switch, the second gamma generator is connected to the data driver through the second switch; in a same moment, when one of the first switch and the second switch is controlled to be turned on, the first gamma voltage or the second gamma voltage corresponding to the first switch or the second switch which is turned on is inputted to the data driver;

wherein the first switch and the second switch are connected to a same control signal, the control signal is a square-wave signal; when the square-wave signal is under a high-voltage level, the first switch is turned on, and the second switch is turned off; when the square-wave signal is under a low-voltage level, the first switch is turned off, and the second switch is turned on; and wherein a period of the square-wave signal is T1, a period of a row synchronization signal of the display panel is T2, T1=2×T2; a duty ratio of the square-wave signal is 1/2.

5. The source driving module according to claim 4, wherein the first switch is a N-channel MOS transistor, a gate of the N-channel MOS transistor is connected to the control signal, a source of the N-channel MOS transistor is connected to the first gamma voltage generator, and a drain of the N-channel MOS transistor is connected to the data driver; the second switch is a P-channel MOS transistor, a gate of the P-channel MOS transistor is connected to the control signal, a source of the P-channel MOS transistor is connected to the second gamma voltage generator, and a drain of the P-channel MOS transistor is connected to the data driver.

6. The source driving module according to claim 4, wherein the data diver comprises a data driving chip connected to the display panel through a chip on film structure.

7. A liquid crystal display device, comprising:

a display panel, providing with multiple data lines and multiple scanning lines which are disposed vertically and horizontally, wherein, sub-pixels are formed at intersection regions of the data lines and the scanning lines, the sub-pixels in a same row are connected with a same scanning line, the sub-pixels in a same column is connected with a same data line, three sub-pixels corresponding to each pixel unit are arranged vertically;

a source driving module adapted for providing data signals to the sub-pixels in the display panel through the data lines;

a gate driving module adapted for providing scanning signals to the sub-pixels in the display panel through the scanning lines;

a timing controller adapted for providing a timing control signal to the source driving module and the gate driving module, and sending an image signal waited to be displayed to the source driving module;

wherein the source driving module comprises a gamma voltage generator and a data driver receiving a gamma voltage outputted from the gamma voltage generator and generating a corresponding data signal to a display panel according to the gamma voltage;

wherein the gamma voltage generator includes a first gamma generator and a second gamma voltage generator, the first gamma generator outputs a first gamma voltage, and the second gamma generator outputs a second gamma voltage;

wherein the source driving module further comprises a voltage selector adapted for selecting one of the first gamma voltage and the second gamma voltage in a same moment to input to the data driver;

wherein the voltage selector comprises a first switch and a second switch; the first gamma voltage generator is connected to the data driver through the first switch, the second gamma generator is connected to the data driver through the second switch; in a same moment, when one of the first switch and the second switch is controlled to be turned on, the first gamma voltage or the second gamma voltage corresponding to the first switch or the second switch which is turned on is inputted to the data drive;

wherein the first switch and the second switch are connected to a same control signal, the control signal is a square-wave signal; when the square-wave signal is under a high-voltage level, the first switch is turned on, and the second switch is turned off; when the square-wave signal is under a low-voltage level, the first switch is turned off, and the second switch is turned on; and wherein a period of the square-wave signal is T1, a period of a row synchronization signal of the display panel is T2, T1=3×T2; a duty ratio of the square-wave signal is 2/3.

8. The liquid crystal display device according to claim 7, wherein the first switch is a N-channel MOS transistor, a gate of the N-channel MOS transistor is connected to the control signal, a source of the N-channel MOS transistor is connected to the first gamma voltage generator, and a drain of the N-channel MOS transistor is connected to the data driver; the second switch is a P-channel MOS transistor, a gate of the P-channel MOS transistor is connected to the control signal, a source of the P-channel MOS transistor is connected to the second gamma voltage generator, and a drain of the P-channel MOS transistor is connected to the data driver.

9. The liquid crystal display device according to claim 7, wherein the data diver comprises a data driving chip connected to the display panel through a chip on film structure.

10. The liquid crystal display device according to claim 7, wherein the three sub-pixels corresponding to each pixel unit are sequentially a red sub-pixel, a green sub-pixel and a blue sub-pixel.

11. A liquid crystal display device, comprising:

a display panel, providing with multiple data lines and multiple scanning lines which are disposed vertically and horizontally, wherein, sub-pixels are formed at intersection regions of the data lines and the scanning lines, the sub-pixels in a same row are connected with a same scanning line, the sub-pixels in a same column is connected with a same data line, three sub-pixels corresponding to each pixel unit are arranged vertically;

a source driving module adapted for providing data signals to the sub-pixels in the display panel through the data lines;

a gate driving module adapted for providing scanning signals to the sub-pixels in the display panel through the scanning lines;

a timing controller adapted for providing a timing control signal to the source driving module and the gate driving module, and sending an image signal waited to be displayed to the source driving module;

wherein the source driving module comprises a gamma voltage generator and a data driver receiving a gamma voltage outputted from the gamma voltage generator and generating a corresponding data signal to a display panel according to the gamma voltage;

wherein the gamma voltage generator includes a first gamma generator and a second gamma voltage generator, the first gamma generator outputs a first gamma voltage, and the second gamma generator outputs a second gamma voltage;

wherein the source driving module further comprises a voltage selector adapted for selecting one of the first gamma voltage and the second gamma voltage in a same moment to input to the data driver;

wherein the voltage selector comprises a first switch and a second switch; the first gamma voltage generator is connected to the data driver through the first switch, the second gamma generator is connected to the data driver through the second switch; in a same moment, when one of the first switch and the second switch is controlled to be turned on, the first gamma voltage or the second gamma voltage corresponding to the first switch or the second switch which is turned on is inputted to the data drive;

wherein the first switch and the second switch are connected to a same control signal, the control signal is a square-wave signal; when the square-wave signal is under a high-voltage level, the first switch is turned on, and the second switch is turned off; when the square-wave signal is under a low-voltage level, the first switch is turned off, and the second switch is turned on; and wherein a period of the square-wave signal is T1, a period of a row synchronization signal of the display panel is T2, T1=2×T2; a duty ratio of the square-wave signal is 1/2.

12. The liquid crystal display device according to claim 11, wherein the first switch is a N-channel MOS transistor, a gate of the N-channel MOS transistor is connected to the control signal, a source of the N-channel MOS transistor is connected to the first gamma voltage generator, and a drain of the N-channel MOS transistor is connected to the data driver; the second switch is a P-channel MOS transistor, a gate of the P-channel MOS transistor is connected to the control signal, a source of the P-channel MOS transistor is connected to the second gamma voltage generator, and a drain of the P-channel MOS transistor is connected to the data driver.

13. The liquid crystal display device according to claim 11, wherein the data diver comprises a data driving chip connected to the display panel through a chip on film structure.

14. The liquid crystal display device according to claim 11, wherein the three sub-pixels corresponding to each pixel unit are sequentially a red sub-pixel, a green sub-pixel and a blue sub-pixel.

* * * * *